United States Patent [19]

Watanabe et al.

[11] Patent Number: 4,908,290

[45] Date of Patent: Mar. 13, 1990

[54] TONER FOR DEVELOPING LATENT ELECTROSTATIC IMAGES

[75] Inventors: Yoichiro Watanabe, Fuji; Mitsuo Aoki; Tetsuo Isoda, both of Namazu; Nobuhiro Nakayama, Susono; Fumihiro Sasaki; Karumi Kakigawa, both of Numazu, all of Japan

[73] Assignee: Ricoh Company, Ltd., Tokyo, Japan

[21] Appl. No.: 120,563

[22] Filed: Nov. 13, 1987

[30] Foreign Application Priority Data

Nov. 17, 1986 [JP] Japan ..... 61-274830
May 28, 1987 [JP] Japan ..... 62-134387

[51] Int. Cl.[4] ..... G03G 9/08

[52] U.S. Cl. ..... 430/106.6; 430/109

[58] Field of Search ..... 430/106, 106.6, 107, 430/109, 126, 122

[56] References Cited

U.S. PATENT DOCUMENTS 4,340,660 7/1982 Kiuchi et al. ..... 430/106.6
4,481,274 11/1984 Mitsuhashi et al. ..... 430/109
4,628,019 12/1986 Suematsu et al. ..... 430/109

*Primary Examiner*—John L. Goodrow
*Attorney, Agent, or Firm*—Flynn, Thiel, Boutell & Tanis

[57] ABSTRACT

A toner for developing latent electrostatic images is disclosed, which comprises a colorant, and a binder agent comprising (i) polyester resin or epoxy resin, and (ii) styrene - methyl acrylate copolymer.

5 Claims, No Drawings

TONER FOR DEVELOPING LATENT ELECTROSTATIC IMAGES

BACKGROUND OF THE INVENTION

The present invention relates to a toner for developing latent electrostatic images in electrophotography, electrostatic recording, electrostatic printing and the like.

In electrophotography, a latent electrostatic image is formed on a photoconductor by a variety of conventional methods and the latent electrostatic image is then developed by use of a toner to a visible toner image. When necessary, the developed toner image is then transferred to a transfer sheet and fixed thereto, for instance, by application of heat thereto.

As the method of developing a latent electrostatic image to a visible image, a variety of methods, such as magnetic brush development method, cascade development method and powder-cloud method, are known. In any of these development methods, the step of fixing toner images to a transfer sheet is particularly important.

Currently as the method of fixing such toner images to a transfer sheet, methods of applying heat to the toner images to soften or fuse a thermoplastic resin contained in the toner particles and fix the toner particles to the transfer sheet are in general use, for instance, by using a heat roller for fixing toner images, or fixing toner images in a heated atmosphere of by a flash light. Of these methods, the image fixing method using a heat roller (hereinafter referred to as the heat roller image fixing method) is used most at present because of its quick energization and high heat application efficiency with a minimum thermal energy consumption.

However, in this heat roller image fixing method, a heat roller comes into direct contact with a toner which is fused or melted by application of heat thereto. Therefore, part of the melted toner adheres to the surface of the heat roller and the toner adhering to the heat roller is then successively transferred to transfer sheets, thus the so-called offset phenomenon takes place.

As a method of preventing such an offset phenomenon, there is known a method of applying silicone oil to the surface of a heat roller to minimize the adhesion of the toner to the heat roller. In this method, since the step of applying an oily material such as silicone oil to the heat roller is necessary, an image fixing apparatus for this method is complex in mechanism.

Another method of preventing such an offset phenomenon, a method of providing a toner itself with an offset preventing property has been proposed, in which a binder resin having a high glass transition temperature (Tg) and a high molecular weight is employed in the toner to elevate the melting viscoelasticity of the toner. This method, however, has the drawbacks that the image fixing performance of the toner is insufficient for use in practice and the toner cannot be used for image fixing at low temperatures for attaining high speed image fixing and saving thermal energy.

In general, in order to improve the low temperature image fixing performance of a toner, it is necessary to decrease the viscosity of the toner when melted and to increase the contact area thereof with a transfer sheet. In order to attain this, it is required that the glass transition temperature (Tg) and the molecular weight of a binder resin contained in the toner be decreased.

Generally since the low temperature image fixing performance and the offset preventing performance contradict each other, it is extremely difficult to develop a toner having such contradictory properties.

In accordance with the recent quick development of stencil printing and the recent demand for polyvinyl chloride products for stencil printing, a variety of requests have been made with respect to the copied materials using toner.

For instance, in the conventional stencil printing, that is, mimeograph, a stencil master paper is manually cut, for instance, with a steel pen. Recently, however, a printing plate using the stencil paper is quickly made by the following method. A stencil master paper is superimposed on an original which bears images. A thin film made of, for instance, polyester, is further superimposed on the master paper. This composition is exposed to flash light, so that the portions of the thin film corresponding to the images of the original are caused to fuse instantly and perforated in such a degree as to be proportional to the image densities of the images, by utilizing the differences in the light absorption degree of the film, thus a printing plate is instantly made.

In such a plate making method using a stencil paper, when an original which bears toner images is employed, the toner of the fixed images is fused in the course of the above plate printing process and adheres to the perforated portions of the film. When this occurs during the printing plate making process, the image quality obtained by the printing plate is significantly decreased.

For the purpose of solving this problem, for instance, in Japanese Patent Publication 51-23354, there is proposed a toner comprising a vinyl polymer which is appropriately cross-linked by use of a cross linking agent and a molecular weight adjusting agent, and in Japanese Patent Publication 55-6805, there is proposed a toner comprising a polymer with a repetition unit of an $\alpha,\beta$-unsaturated ethylene monomer, with the molecular weight distribution thereof being broadened in such a manner that the ratio of the weight average molecular weight to the number average molecular weight falls in the range of 3.5 to 40. Further, there has been proposed a toner comprising blended vinyl polymers with different glass transition temperatures (Tg), molecular weights and gel contents.

Unquestionably, in the above-mentioned toners, the temperature range between the lower limit temperature for image fixing and the offset initiation temperature is broadened. However, when the toners are formulated so as to have a sufficient offset preventing property, the image fixing temperature cannot be sufficiently lowered. On the other hand, when the image fixing temperature is sufficiently lowered, a sufficient offset preventing property cannot be obtained.

In Japanese Laid-Open Patent Application 57-208559, there is proposed a toner comprising a cross-linked polyester resin and an offset preventing agent. This toner is excellent in the low temperature image fixing performance and the offset preventing performance. However, the toner has the shortcoming that it adheres to a heated stencil master paper. This shortcoming cannot be eliminated even if a variety of die lubricants serving as offset preventing agent are added to the toner.

Further, in Japanese Laid-Open Patent Application 54-114245, there is proposed a toner comprising 50 to 95 wt. % of a polyester resin having a low molecular weight and a low melting point and a vinyl resin having a weight average molecular weight of 500,000 or more, which is excellent in both the low temperature image fixing performance and the offset preventing performance. In this toner, the difference in melting viscosity between the two resins is so large that the toner cannot be obtained in a good dispersing state even if the components are fused and kneaded for a long period of time with application of strong shearing force thereto.

Generally it is reported that when uncompatible resins are blended, these resins form an island-sea structure. This theory is described, for instance, in Plastics 13, No. 9, p. 1 (1962). Improvement of the dispersibility of a resin component means to reduce the size of the islands of the resin component. For example, when a plurality of resins is fused and blended, the lower the melting viscosity of each resin, the better the dispersed state of the blended resins.

An observation of the dispersing state of a toner shown in Example 1 of the previously mentioned Japanese Laid-Open Patent Application 54-114245 by use of a transmitting-type microscope indicates that a styrene-butadiene resin is present in the form of large islands in a sea-like polyester, with non-uniform dispersion of carbon black, and that the toner particles are not uniformly dispersed. When there toner particles are mixed with an iron powder carrier, the charge quantity distribution of the toner is abnormally broad. When this toner is used in repetition for making copies, the fogging of images takes place. When a stencil printing master is prepared by use of an original which bears images formed by fixing this toner, a large amount of the toner adheres to the stencil printing master, and the images printed by the master are not clear.

Japanese Laid-Open Patent Application 59-107359 discloses a toner comprising 5 to 45 wt. % of a condensed polymer prepared by polymerizing a polyfunctional monomer, 20 to 60 wt. % of which polyfunctional monomer is a three or more functional monomer, and 95 to 55 wt. % of a polymer prepared by polymerizing a vinyl monomer. This monomer has the shortcoming that the low temperature image fixing performance is insufficient because of the high viscoelasticity of the condensed polymer which has a three-dimensional network structure.

In addition to the above, there has been proposed a method of using in a toner a graft copolymer consisting of a polyester resin and a vinyl resin with a common segment introduced into the two resins in order to improve the mutual dispersion of the two resins. This toner, however, is not sufficient in the offset preventing performance and low temperature image fixing performance.

The contamination of polyvinyl chloride products with a conventional toner is caused as follows. A plasticizer such as dioctyl phthalate (DOP) and dibutyl phthalate (DBP) contained in a soft polyvinyl chloride is transferred to the toner, the viscosity of the toner is decreased by the plasticizer, so that the toner adheres to the polyvinyl chloride products.

Conventionally, as a binder resin for a toner for developing latent electrostatic images, a styrene copolymer and a styrene - acrylate or methacrylate copolymer are in general use. These polymeric resins are compatible with the plasticizers contained in polyvinyl chloride. Therefore the contamination of soft polyvinyl chloride products with the toner is apt to occur under the above-mentioned process.

Several methods of preventing such contamination of polyvinyl chloride products with the toner have been proposed. None of them, however, can attain the low temperature image fixing performance which is one of the most important requirements for the toner and the prevention of the adhesion of the fused toner to the master paper for stencil printing, although the contamination of vinyl chloride products with the toner can be prevented to some extent.

For instance, Japanese Patent Publication 55-10906 and Japanese Laid-Open Patent Application 59-166965 propose a method of introducing a hydrophilic group into a binder resin. The toner using such a binder resin is capable of preventing the contamination of polyvinyl chloride products to some extent, but has a fatal drawback in that the charge quantity of the toner significantly changes depending upon the ambient conditions such as temperature and humidity, and accordingly the image quality obtained by the toner changes depending upon such ambient conditions.

Further, Japanese Laid-Open Patent Application 59-162564 proposes toners in which a homopolymer or copolymer of acrylate or methacrylate, having an alkyl group having 3 or less carbon atoms, or a copolymer of styrene and acrylate or methacrylate with the styrene monomer unit thereof being 30 wt. % or less, is employed as a binder resin. In both cases where the homopolymer of acrylate is used and where the copolymer of styrene and acrylate or methacrylate, with the content of styrene being 30 wt. % or less, is used, the glass transition temperature (Tg) of the polymers is so low that the toners containing such binder resins tend to aggregate during storage. When the homopolymer or copolymer of methacrylate is employed, the glass transition temperature (Tg) is so high that the preservability of the toner is good, but the image fixing performance is insufficient for use in practice.

SUMMARY OF THE INVENTION

It is therefore an object of the present invention to provide a toner for developing latent electrostatic images, which is excellent in offset preventing performance, and low temperature image fixing performance, and which, when fused, neither adheres to a master paper for stencil printing during stencil plate making process nor contaminates polyvinyl chloride products.

Another object of the present invention is to provide a toner for developing latent electrostatic images which is excellent in charging uniformity and stable in image formation performance even if the ambient conditions vary.

According to the present invention, these objects are achieved by a toner which comprises a colorant and a binder agent comprising (i) polyester resin or epoxy resin and (ii) styrene - methyl acrylate copolymer.

DETAILED DESCRIPTION OF THE PREFERRED EMBODIMENTS

In the present invention, styrene - methyl acrylate copolymer is employed as one of the essential components of a binder resin of the toner according to the present invention.

Generally it is said that a toner using a styrene - acryl copolymer as a binder is apt to adhere to soft polyvinyl chloride products and accordingly contaminates the same.

Unlike the conventional styrene - acryl copolymers, the styrene - methyl acrylate copolymer employed in the present invention, however, does not contaminates soft polyvinyl chloride products and does not adhere to a master paper for stencil printing when fused.

The reason for this is not clarified yet. However, it is considered that this excellent uncontaminating performance of the polymer to soft polyvinyl chloride products stems from the fact that the SP value (solubility parameter value) of the methyl acrylate copolymer, in particular, the SP value of the hydrogen bonding component thereof, is exceedingly far from the SP value of the plasticizers contained in the soft polyvinyl chloride products.

Further, the homopolymer of methyl acrylate has a higher glass transition temperature (Tg) and is harder and less flexible than the homopolymers of other acrylic acid alkyl esters. Therefore even when methyl acrylate is compolymerized with styrene, the above-mentioned hardness is maintained, so that the styrene - methyl acrylate copolymer employed in the present invention serves to prevent the toner from adhering to the stencil printing master paper even when the toner is fused.

The fusing adhesion preventing function of the toner in the process of stencil master plate making can be enhanced by increasing the viscoelasticity at high temperatures and the molecular weight of the styrene - methyl acrylate copolymer. By the cross-linking of the copolymer, the fusing adhesion preventing function of the toner can be further improved.

In the present invention, polyester resin or epoxy resin is employed together with the styrene - methyl acrylate copolymer in the binder resin.

It is preferable that the polyester resin have a weight average molecular weight of 8,000 to 16,000 and a glass transition temperature of 50° to 65° C.

It is preferable that the epoxy resin have a weight average molecular weight of 2,000 to 12,000 and a glass transition temperature of 50° to 65° C.

Both the polyester resin and epoxy resin can be prepared easily by condensation polymerization. Both resins have high adhesiveness because of the presence of polar groups in the molecules thereof. Further since the SP values of both resins are far from the SP values of plasticizers contained in the vinyl chloride resin, the contamination of polyvinyl chloride products with the toner is advantageously minimized.

The polyester resins that can be employed in the toner according to the present invention can be prepared from dihydric alcohols in Group A and dibasic acids in Group B as follows. Further, trialcohols and other polyhydric alcohols and carboxylic acids in Group C may be added as a third component when preparing the polyester resins.

Group A: ethylene glycol, triethylene glycol, 1,2-propylene gylcol, 1,3-propylene glycol, 1,4-butandiol, neopentyl glycol, 1,4-butenediol, 1,4-bis(hydroxymethyl)cyclohexanone, Bisphenol A, hydrogenated Bisphenol A, polyoxyethylenated Bisphenol A, polyoxypropylene(2,2)-2,2-bis (4-hydroxyphenyl)propane, polyoxypropylene (3,3)-2,2-bis(4-hydroxyphenyl)propane, polyoxyethylene(2,0)-2,2-bis(4-hyrdroxyphenyl)-propane, polyoxypropylene(2,0)-polyoxyethylene(2,0)-2,2-bis(4-hydroxyphenyl)propane.

Group B: maleic acid, fumaric acid, mesaconic acid, citraconic acid, itaconic acid, glutaconic acid, phthalic acid, isophthalic acid, terephthalic acid, cychohexanedicarboxylic acid, succinic acid, adipic acid, sebacic acid, malonic acid, linoleic acid, anhydrides of the above acids, and esters of the above acids and lower alchols.

Group C: trihydric alcohols an other polyhydric alcohols such as glycerin, trimethylolpropane, and pentaerythritol; and tribasic and polybasic carboxylic acids such as trimellitic acid and pyromellitic acid.

In the present invention, when polyester resin is employed in the toner, other conventional thermoplastic resins such as epoxy resin, polyamide resin, urethane resin, phenol resin, butyral resin, styrene - butadiene resin, syrene - methacryl resin, and copolymer resin of styrene and acrylic acid alkyl ester having an alkyl group having two or more carbon atoms may be added to the binder resin in such an amount as not to have adverse effects on the toner, for instance, 20 wt. % or less of the entire weight of the binder resin in the toner.

Further, in the present invention, when epoxy resin is employed in the toner, other conventional thermoplastic resins such as polyester resin, polyamide resin, urethane resin, phenol resin, butyral resin, styrene - butadiene resin, styrene - methacryl resin, and copolymer resin of styrene and acrylic acid alkyl ester having an alkyl group having two or more carbon atoms may be added to the binder resin in such an amount as not to have adverse effects on the toner, for instance, 20 wt. % or less of the entire weight of the binder resin in the toner.

As mentioned previously, when resins which are uncompatible with each other are blended, those blended resins usually form an island-sea structure. In the present invention, it is preferable that the styrene - methyl acrylate copolymer take a sea structure and the polyester resin or epoxy resin take an island structure.

More specifically, it is preferable that the resin which forms a sea structure constitute a continuous layer and provide the toner an inner aggregation force when fused, so that the resin in the island structure is provided with an adhesion function. Thus the two resins play their own advantageous roles. In this case, the polyester resin or epoxy resin, which forms islands and is fusible at a low temperature, melts first at the time of image fixing, so as to help the entire toner particles become thermoplastic, thus when the toner particles are depressed by an image fixing roller, the polyester resin or epoxy resin is pushed to come out to the outer surface of the toner particles, whereby the image fixing performance is significantly enhanced as compared with the expected conventional image fixing performance in view of the actual content of the polyester resin or epoxy resin in the binder resin.

In order to form such an island-sea structure, it is preferable that the amount of the polyester resin or epoxy resin in the binder resin be in the range of 20 to 45 wt. % of the binder resin. When the amount of the polyester resin or epoxy resin is in the above-mentioned range to form an island-sea structure, the inner aggregation force of the toner is enhanced and the offset preventing performance and the fusing and adhesion preventing performance to a master paper for stencil printing can be further improved.

When the sea structure is made fusible at a low temperature and the island structure is made highly viscoelastic, with the expectation that the island structure will serve as filler, the inner aggregation force of the toner cannot be increased at the time of fusing because that exception cannot be met.

In the present invention, it is preferable that the polyester resin or epoxy resin and the styrene - methyl acrylate copolymer be dispersed uniformly and the charge quantities of the toner particles be made uniform as much as possible.

This is because there is a toner charge quantity range in which images are most readily developed, so that when the toner charge quantity range is broad, selective development takes place in the broad charge quantity range. The result is that in the course of the repeated use of the toner for development, the toner which was not used for development accumulates, which causes the fogging and spreading of the images, thereby degrading the entire image quality.

The polyester resin employed in the present invention has a more intense negative polarity than the styrene - methyl acrylate copolymer. Therefore, unless the toner particles are uniformly dispersed, the charging of each toner particles is non-uniform and accordingly a toner having a narrow charge quantity distribution cannot be obtained.

From this point of view and for the objects of the present invention, it is preferable that the polyester resin for use in the present invention have a weight average molecular weight of 8,000 to 16,000, and a glass transition temperature (Tg) of 55° to 60° C., and the styrene - methyl acrylate copolymer have a weight average molecular weight of 200,000 to 500,000, a gel content of 15 to 50%, and a glass transition temperature (Tg) of 55° to 70° C.

With respect to the epoxy resin for use in the present invention, for the same reasons as mentioned above, it is preferable that the epoxy resin have a weight average molecular weight of 2,000 to 12,000, and a glass transition temperature (Tg) of 55° to 60° C.

In particular, when (i) an epoxy resin having a weight average molecular weight of 2,000 or more, and a glass transition temperature of 50° C. or more, and (ii) a styrene - methyl acrylate copolymer having a weight average molecular weight of 500,000 or less, a gel content of 50% or less, and a glass transition temperature (Tg) of 70° C. or less are employed, the mutual dispersibility of the two resins is good and the uniform chargeability of the toner can be obtained without difficulty.

In the present invention, the molecular weight, glass transition temperature (Tg) and gel content of each resin are assessed by the following methods:

(1) Molecular Weight

The measurement of molecular weight is performed by gel permeation chromatography under the following conditions:

A sample resin is dissolved in tetrahydrofuran with a concentration of 0.1 wt. % and the molecular weight of the sample resin is assessed by comparing the diffusion rate of the solution at a flow rate of 1 ml/min at 20° C. with a calibration curve of polyethylene standard dispersion samples.

(2) Glass Transition Temperature (Tg) differential scanning calorimeter.

(3) Gel Content (1) To 0.01 g of a sample resin, 50 ml of tetrahydrofuran is added. The mixture is stirred for 3 hours.

(2) The above mixture is filtered through a glass filter backed with sellaite #545 with suction. After the filtration, the glass filter is dried under reduced pressure and then weighed. It is supposed that the weight is A.

(3) When the weight of the glass filter before the filtration is B, the gel content is determined by the formula, $$\frac{A - B}{0.01} \times 100$$

As the colorant for use in the toner according to the present invention, for example, the following pigments and dyes can be used:

Black Pigments

Carbon black, acetylene black, lamp black, and aniline black.

Yellow Pigments

Chrome yellow, zinc yellow, cadmium yellow, yellow iron oxide, mineral fast yellow, nickel titanium yellow, naples yellow, Naphthol Yellow S, Hanza Yellow G, Hanza Yellow 10G, Benzidine Yellow G, Benzidine Yellow GR, Quinoline Yellow Lake, Permanent Yellow CG, and Tartrazine Lake.

Orange Pigments

Chrome orange, molybdenum orange, Permanent Orange GTR, Pyrazolone Orange, Vulcan Orange, Indanthrene Brilliant Orange RK, Benzidine Orange G, and Indanthrene Brilliant Orange GK.

Red Pigments

Red iron oxide, cadmium red, red lead, cadmium mercury sulfide, Permanent Red 4R, Lithol Red, Pyrazolone Red, Watching Red Calcium Salt, Lake Red D, Brilliant Carnine 6B, eosine lake, Rhodamine Lake B, Alizarine Lake, and Brilliant Carmine 3B.

Purple Pigments

Manganese violet, Fast Violet B, and Methyl Violet Lake.

Blue Pigments

Ultramarine, cobalt blue, Alkali Blue Lake, Victoria Blue Lake, Phthalocyanine Blue, Metal-free Phthalocyanine Blue, Phthalocyanine Blue (partially chlorinated), Fast Sky Blue, and Indanthrene Blue BC.

Green Pigments

Chrome green, chromium oxide, Pigment Green B, Malachite Green Lake, and Fanal Yellow Green.

White Pigments

Zinc flower, titanium oxide, antimony white, and zinc sulfide.

Extender Pigments

Barite powder, barium carbonate, clay, silica, white carbon, talc, and alumina white.

Dyes (basic dyes, acidic dyes and direct dyes)

Nigrosine, Methylene Blue, Rose Bengale, Quinoline Yellow and Ultramarine Blue.

As the polarity and/or charge control agent for the toner according to the present invention, the following highly polar materials can be employed: Nigrosine, monoazo dyes, zinc hexadecyl succinate, alkyl esters of naphthoic acid, alkylamides of naphthoic acid, nitrohumic acid, N,N'-tetramethyldiamine benzophenone, N,N'-tetramethylbenzidine, triazine, and salicylic acid metal complexes.

When the toner according to the present invention is made a magnetic toner, any of ferromagnetic elements and alloys and compounds containing ferromagnetic elements is contained in the toner. Examples of such alloys and compounds are alloys of iron, cobalt, nickel and manganese, such as magnetite, hematite, and ferrite, and compounds of such magnetic metals, and other conventional ferromagnetic alloys.

It is preferable that any of these magnetic materials for use in the toner according to the present invention have an average particle size ranging from about 0.1 μm to about 5 μm, more preferably an average particle size ranging from 0.1 μm to 1 μm, and the amount thereof in the toner be in the range of about 1 wt. % to about 60 wt. %, more preferably in the range of 5 wt. % to 40 wt. %; of the entire weight of the toner.

As mentioned previously, the toner according to the present invention has so high a melting viscoelasticity that the so-called offset phenomenon does not take place at the time of image fixing by a heat roller. However, when necessary, a conventional die lubricant, such as a variety of waxes, and low molecular weight polypropylene and polyethylene, can be contained in the toner. Further for improvement of the fluidity of the toner particles, and for easy cleaning of the heat roller and other devices to which the toner may adhere, silica, titanium oxide, alumina, silicate carbonate, zinc oxide, metal salts of higher fatty acids, and finely-divided hard resin particles may be mixed with the toner.

The toner according to the present invention can be prepared by the conventional method, such as the mixing method and grinding method.

When the toner according to the present invention is used for development by the cascade development method, magnetic brush development method, and C-shell development method, it is preferable that the volume average particle size thereof be about 30 μm or less, more preferably in the range of about 4 μm to about 20 μm.

As the carrier particles employed in the cascade development method, magnetic brush development method and C-shell development method coated carrier particles and uncoated carrier particles are known. As the carrier particles for use with the toner according to the present invention, any carrier particles can be used so long as they are charged to a polarity opposite to that of the toner particles when the toner particles are brought into close contact with the carrier particles and deposited on the surface thereof.

In other words, the toner according to the present invention can be used by mixing with the conventional carrier for development of latent electrostatic images formed on a conventional photoconductor.

The present invention will now be explained in detail with reference to the following examples, which are given for illustration of the invention and are not intended to be limiting thereof.

EXAMPLE 1-1

Five polyester resins, each consisting of polyoxyethylenated bisphenol A and terephthalic acid, having weight average molecular weights of about 6,000, 9,000, 12,000, 15,000 and 18,000, and each having a glass transition temperature (Tg) of 55° C., were prepared.

A styrene - methyl acylate copolymer (hereinafter referred to as the St/MA copolymer) having a weight average molecular weight of 350,000, a gel content of 30%, and a glass transition temperature of 60° C., was obtained by suspension polymerization of styrene monomer and methyl acrylate monomer, with addition thereto of benzoyl peroxide and divinylbenzene.

35 parts by weight of each of the above-mentioned five polyester resins, 65 parts by weight of the St/MA copolymer, 10 parts by weight of carbon black, 1 part by weight of Nigrosine dye, and 4 parts by weight of a low molecular weight polypropylene (Trademark "Viscol 550P" made by Sanyo Chemical Industries, Ltd.) were fused and kneaded in a two roller mill for 1 hour and then cooled. The cooled mixture was roughly ground, teen finely divided by a jet mill and classified by a pneumatic classifier, whereby five toners No. 1-1 through No. 1-5 according to the present invention, the toner particles of each toner having a volume mean diameter of 11 μm, were obtained.

Each of the toners was subjected to (i) a contamination test for checking the contamination of a polyvinyl chloride product with each toner, (ii) a toner fusing and adhesion test for checking the adhesion of the fused toner to a stencil printing master paper, (iii) an image fixing test for determining the lower limit temperature for image fixing required by each toner, (iv) an offset test for determining the offset initiation temperature of each toner, and (v) a charging test for evaluating the uniform chargeability of each toner.

More specifically, the above tests were performed in accordance with the following steps. The results are shown in Table 1-1.

Step (1): Preparation of Toner Image Samples 4 parts by weight of each toner and 96 parts by weight of an iron oxide powder carrier (Trade "TEFV 200/300" made by Nihon Teppun Co., Ltd.) were mixed by a blender for 30 minutes, so that five developers No. 1-1 through No. 1-5 were prepared. By use of each of the developers in a commercially available electrophotographic copying machine (Trademark "FT-8030" made by Ricoh Co., Ltd.), toner image samples were prepared. These toner image samples were made so as to include a black area of 10 mm×50 mm, having a reflection density of 1.2, in each sample.

Step (2): Contamination of Polyvinyl Chloride Products with Toners

Each of the toner image samples obtained in the above Step (1) was covered with a sheet made of a soft polyvinyl chloride (hereinafter referred to as the polyvinyl chloride sheet) and a pressure of 1 kg/A-4 size was applied to the superimposed polyvinyl chloride sheet. The toner image sample was allowed to stand at 40° C. for 72 hours under this condition. Thereafter, the polyvinyl chloride sheet was removed and then it was inspected whether or not any toner adhered to the polyvinyl chloride sheet.

When the polyvinyl chloride sheet was contaminated with the toner, the area on the sheet corresponding to the above-mentioned black area of each toner image sample was subjected to a density inspection test by use of a Macbeth densitometer, so that the reflection density of the corresponding area on the polyvinyl chloride sheet was measured. The contamination of the polyvinyl chloride sheet was determined by the value obtained by subtracting the density of the background area (where no toner was deposited) from the above reflection density of the corresponding area. The greater the contamination, the larger this value. As the matter of course, this value was zero when there was no contamination of the polyvinyl chloride sheet with the toner.

Step (3): Adhesion of Fused Toner to Master Paper for Stencil Printing

Each of the toner image samples obtained in Step (1) was set at a stencil printing master sheet in a commercially available stencil plate making machine (Trademark "RISOGRAPH FX 7200" made by Riso Kagaku Corp.) with the dial set at zero in a dry mode, so that a stencil printing master plate was prepared.

The toner image sample was removed from the stencil printing master. The area on the master corresponding to the black area of each toner image sample was subjected to a density inspection test by use of a Macbeth densitometer, so that the reflection density of the corresponding area on the master was measured. The adhesion of the fused toner to the master was determined by the value obtained by subtracting the density of the background area (where no toner adhered) from the above reflection density of the corresponding area. The greater the adhesion, the larger this value. When there is no adhesion, this value was about 0.01. The tolerance limit for this value is 0.09 in view of the printing quality for use in practice.

Step (4): Lower Limit Temperature for Image Fixing and Offset Initiation Temperature The lower limit temperature for image fixing and the offset initiation temperature were investigated by the sample developers and the same copying machine as those employed in the preparation of the toner samples, provided that no silicone oil was applied to the image fixing apparatus of the copying machine and the image fixing apparatus was modified in such a manner that the image fixing temperature (i.e., the surface temperature of image fixing heat rollers) could be changed as desired. It is preferable that the lower limit temperature for a toner for low temperature image fixing be 145° C. or less.

Step (5): Uniformity of Toner Chargeability

The charge quantity of each toner was measured by use of a blow-off apparatus.

Each developer prepared in Step (1) was subjected to a first blow-off test by blowing off 4 g of each developer with application of an air pressure of 0.5 kg/cm$^2$ thereto, so that the charge quantity $Q_1$ ($\mu$C/g) of the toner of the developer was measured. The developer subjected to the above blow-off test was further subjected to a second blow-off test with application of an air pressure of 2.5 kg/cm$^2$, so that the charge quantity $Q_2$ ($\mu$C/g) of the toner of the developer was then obtained. The difference between the charge quantity $Q_1$ obtained in the first blow-off test and the charge quantity $Q_2$ obtained in the second blow-off test, that is, $Q_2$-$Q_1$, was divided by the average value of the two charge quantities $$\frac{Q_2 + Q_1}{2},$$

to obtain a value of $$\frac{Q_2 - Q_1}{(Q_1 + Q_2)/2},$$

which indicates the uniformity of the chargeability of the toner. The larger the value, the greater the distribution of the charge quantity of the toner and accordingly the less preferable the quality of the toner. The tolerance limit for this value for use in practice is about 0.5.

TABLE 1-1

| No. | Polyester Resin Mw | Tg | wt. % | Styrene-methyl acrylate copolymer Mw | Gel Ratio | Tg | wt. % | Contamination of PVC Products | Adhesion to Stencil Master | Lower Limit Temp. (°C.) for Image Fixing | Offset Temp. (°C.) | Charging Uniformity |
|---|---|---|---|---|---|---|---|---|---|---|---|---|
| 1-1 | 6000 | 55 | 35 | 350000 | 30 | 60 | 65 | 0 | 0.08 | 125 | 240 or more | 0.61 |
| 1-2 | 9000 | 55 | 35 | 350000 | 30 | 60 | 65 | 0 | 0.06 | 130 | 240 or more | 0.45 |
| 1-3 | 12000 | 55 | 35 | 350000 | 30 | 60 | 65 | 0 | 0.05 | 137 | 240 or more | 0.35 |
| 1-4 | 15000 | 55 | 35 | 350000 | 30 | 60 | 65 | 0 | 0.04 | 143 | 240 or more | 0.29 |
| 1-5 | 18000 | 55 | 35 | 350000 | 30 | 60 | 65 | 0 | 0.04 | 148 | 240 or more | 0.26 |

Note
Mw: Weight average molecular weight,
Tg: Glass transition temperature,
Gel Ratio: Gel content
wt. %: Mixing ratio of polyester resin in the toner.

EXAMPLE 1-2

Six polyester resins, each consisting of polyoxyethylenated bisphenol A and terephthalic acid, having a weight average molecular weight of 12,000, and glass transition temperatures (Tg) of about 45° C., 50° C., 60° C., 65° C. and 70° C. were prepared.

With the formulation of 35 parts by weight of each of the above-mentioned six polyester resins, 65 parts by weight of the St/MA copolymer prepared in Example 1-1, 10 parts by weight of carbon black, 1 part by weight of Nigrosine dye, and 4 parts by weight of a low molecular weight polypropylene (Trademark "Viscol 550P" made by Sanyo Chemical Industries, Ltd.) and under the same procedure as in Example 1-1, toners No. 1-6 through No. 1-11 according to the present invention were prepared.

Each of the above toners was subjected to the same evaluation tests as in Example 1-1. The results are shown in Table 1-2.

TABLE 1-2

| No. | Polyester Resin Mw | Tg | wt. % | Styrene-methyl acrylate copolymer Mw | Gel Ratio | Tg | wt. % | Contamination of PVC Products | Adhesion to Stencil Master | Lower Limit Temp. (°C.) for Image Fixing | Offset Temp. (°C.) | Charging Uniformity |
|---|---|---|---|---|---|---|---|---|---|---|---|---|
| 1-6 | 12000 | 45 | 35 | 350000 | 30 | 60 | 65 | 0 | 0.09 | 123 | 240 or more | 0.74 |
| 1-7 | 12000 | 50 | 35 | 350000 | 30 | 60 | 65 | 0 | 0.07 | 128 | 240 or more | 0.49 |
| 1-8 | 12000 | 55 | 35 | 350000 | 30 | 60 | 65 | 0 | 0.05 | 137 | 240 or more | 0.35 |
| 1-9 | 12000 | 60 | 35 | 350000 | 30 | 60 | 65 | 0 | 0.05 | 140 | 240 or more | 0.31 |

TABLE 1-2-continued

| No. | Polyester Resin Mw | Tg | wt. % | Styrene-methyl acrylate copolymer Mw | Gel Ratio | Tg | wt. % | Contamination of PVC Products | Adhesion to Stencil Master | Lower Limit Temp. (°C.) for Image Fixing | Offset Temp. (°C.) | Charging Uniformity |
|---|---|---|---|---|---|---|---|---|---|---|---|---|
| 1-10 | 12000 | 65 | 35 | 350000 | 30 | 60 | 65 | 0 | 0.04 | 145 | 240 or more | 0.27 |
| 1-11 | 12000 | 70 | 35 | 350000 | 30 | 60 | 65 | 0 | 0.03 | 155 | 240 or more | 0.24 |

EXAMPLE 1-3

A polyester resin consisting of polyoxyethylenated bisphenol A and terephthalic acid, having a weight average molecular weight of 12,000 and a glass transition temperature (Tg) of 55° C., was prepared.

Five St/MA copolymers having weight average molecular weights of about 150,000, 250,000, 350,000, 450,000 and 550,000 were prepared under the same procedure as in Example 1-1 except that the temperature at the time of polymerization and the amounts of benzoyl peroxide and divinylbenzene were changed. These five St/MA copolymers were prepared so as to have a gel content of 30% and a glass transition temperature of 60° C.

With the formulation of 35 parts by the first mentioned polyester resin, 65 parts by weight of each of the five St/MA copolymers prepared in the above, 10 parts by weight of carbon black, 1 part by weight of Nigrosine dye, and 4 parts by weight of a low molecular weight polypropylene (Trademark "Viscol 550P" made by Sanyo Chemical Industries, Ltd.) and under the same procedure as in Example 1-1, toners No. 1-12 through No. 1-16 according to the present invention were prepared.

Each of the above toners was subjected to the same evaluation tests as in Example 1-1. The results are shown in Table 1-3.

TABLE 1-3

| No. | Polyester Resin Mw | Tg | wt. % | Styrene-methyl acrylate copolymer Mw | Gel Ratio | Tg | wt. % | Contamination of PVC Products | Adhesion to Stencil Master | Lower Limit Temp. (°C.) for Image Fixing | Offset Temp. (°C.) | Charging Uniformity |
|---|---|---|---|---|---|---|---|---|---|---|---|---|
| 1-12 | 12000 | 55 | 35 | 150000 | 30 | 60 | 65 | 0 | 0.10 | 130 | 240 or more | 0.29 |
| 1-13 | 12000 | 55 | 35 | 250000 | 30 | 60 | 65 | 0 | 0.07 | 134 | 240 or more | 0.32 |
| 1-14 | 12000 | 55 | 35 | 350000 | 30 | 60 | 65 | 0 | 0.05 | 137 | 240 or more | 0.37 |
| 1-15 | 12000 | 55 | 35 | 450000 | 30 | 60 | 65 | 0 | 0.04 | 141 | 240 or more | 0.44 |
| 1-16 | 12000 | 55 | 35 | 550000 | 30 | 60 | 65 | 0 | 0.03 | 145 | 240 or more | 0.58 |

EXAMPLE 1-4

A polyester resin consisting of polyoxyethylenated bisphenol A and terephthalic acid, having a weight average molecular weight of 12,000 and a glass transition temperature (Tg) of 55° C., was prepared in the same manner as in Example 1-3.

Six St/MA copolymers having gel contents of about 10%, 20%, 30%, 40%, 50%, and 60% were prepared under the same procedure as in Example 1-1 except that the temperature at the time of polymerization and the amounts of benzoyl peroxide and divinylbenzene were changed. These six St/MA copolymers were prepared so as to have a weight average molecular weight of about 350,000 and a glass transition temperature (Tg) of 60° C.

With the formulation of 35 parts by the first mentioned polyester resin, 65 parts by weight of each of the six St/MA copolymers prepared in the above, 10 parts by weight of carbon black, 1 part by weight of Nigrosine dye, and 4 parts by weight of a low molecular weight polypropylene (Trademark "Viscol 550P" made by Sanyo Chemical Industries, Ltd.) and under the same procedure as in Example 1-1, toners No. 1-17 through No. 1-22 according to the present invention were prepared.

Each of the above toners was subjected to the same evaluation tests as in Example 1-1. The results are shown in Table 1-4.

TABLE 1-4

| No. | Polyester Resin Mw | Tg | wt. % | Styrene-methyl acrylate copolymer Mw | Gel Ratio | Tg | wt. % | Contamination of PVC Products | Adhesion to Stencil Master | Lower Limit Temp. (°C.) for Image Fixing | Offset Temp. (°C.) | Charging Uniformity |
|---|---|---|---|---|---|---|---|---|---|---|---|---|
| 1-17 | 12000 | 55 | 35 | 350000 | 10 | 60 | 65 | 0 | 0.11 | 128 | 240 or more | 0.28 |
| 1-18 | 12000 | 55 | 35 | 350000 | 20 | 60 | 65 | 0 | 0.07 | 133 | 240 or more | 0.32 |
| 1-19 | 12000 | 55 | 35 | 350000 | 30 | 60 | 65 | 0 | 0.05 | 137 | 240 or more | 0.37 |
| 1-20 | 12000 | 55 | 35 | 350000 | 40 | 60 | 65 | 0 | 0.03 | 140 | 240 or more | 0.42 |
| 1-21 | 12000 | 55 | 35 | 350000 | 50 | 60 | 65 | 0 | 0.02 | 142 | 240 or more | 0.49 |
| 1-22 | 12000 | 55 | 35 | 350000 | 60 | 60 | 65 | 0 | 0.02 | 145 | 240 or more | 0.62 |

EXAMPLE 1-5

A polyester resin consisting of polyoxyethylenated bisphenol A and terephthalic acid, having a weight average molecular weight of 12,000 and a glass transition temperature (Tg) of 55° C., was prepared in the same manner as in Example 1-3.

Six St/MA copolymers having a weight average molecular weight of 350,000, a gel content of 30%, and glass transition temperatures (Tg) of 50° C., 55° C., 60° C., 65° C., 70° C. and 75° C. were prepared under the same procedure as in Example 1-1 except that the copolymerization ratio of styrene to methyl acrylate was changed.

With the formulation of 35 parts by the first mentioned polyester resin, 65 parts by weight of each of the six St/MA copolymers prepared in the above, 10 parts by weight of carbon black, 1 part by weight of Nigrosine dye, and 4 parts by weight of a low molecular weight polypropylene (Trademark "Viscol 550P" made by Sanyo Chemical Industries, Ltd.) and under the same procedure as in Example 1-1, toners No. 1-23 through No. 1-28 according to the present invention were prepared.

Each of the above toners was subjected to the same evaluation tests as in Example 1-1. The results are shown in Table 1-5.

TABLE 1-5

| | Polyester Resin | | | Styrene-methyl acrylate copolymer | | | | Contamination of PVC | Adhesion to Stencil | Lower Limit Temp. (°C.) for | Offset | Charging |
|---|---|---|---|---|---|---|---|---|---|---|---|---|
| No. | Mw | Tg | wt. % | Mw | Gel Ratio | Tg | wt. % | Products | Master | Image Fixing | Temp. (°C.) | Uniformity |
| 1-23 | 12000 | 55 | 35 | 350000 | 30 | 50 | 65 | 0 | 0.13 | 126 | 240 or more | 0.27 |
| 1-24 | 12000 | 55 | 35 | 350000 | 30 | 55 | 65 | 0 | 0.09 | 132 | 240 or more | 0.32 |
| 1-25 | 12000 | 55 | 35 | 350000 | 30 | 60 | 65 | 0 | 0.05 | 137 | 240 or more | 0.37 |
| 1-26 | 12000 | 55 | 35 | 350000 | 30 | 65 | 65 | 0 | 0.03 | 140 | 240 or more | 0.42 |
| 1-27 | 12000 | 55 | 35 | 350000 | 30 | 70 | 65 | 0 | 0.02 | 143 | 240 or more | 0.48 |
| 1-28 | 12000 | 55 | 35 | 350000 | 30 | 75 | 65 | 0 | 0.02 | 146 | 240 or more | 0.63 |

EXAMPLE 1-6

Toners No. 1-29 through No. 1-33 according to the present invention were prepared by use of the same polyester resin as that employed in Example 1-3, having a weight average molecule weight of 12,000 and a glass transition temperature (Tg) of 55° C., and the St/MA copolymer employed in Example 1-1, having a weight average molecular weight of 350,000, a gel content of 30% and a glass transition temperature (Tg) of 60° C. under the same procedure as in Example 1-1 except that the mixing ratio of the polyester resin to the St/MA copolymer was changed to 10:90, 20:80, 30:70, 40:60, 50:50.

Each of the above toners was subjected to the same evaluation tests as in Example 1-1. The results are shown in Table 1-6.

TABLE 1-6

| | Polyester Resin | | | Styrene-methyl acrylate copolymer | | | | Contamination of PVC | Adhesion to Stencil | Lower Limit Temp. (°C.) for | Offset | Charging |
|---|---|---|---|---|---|---|---|---|---|---|---|---|
| No. | Mw | Tg | wt. % | Mw | Gel Ratio | Tg | wt. % | Products | Master | Image Fixing | Temp. (°C.) | Uniformity |
| 1-29 | 12000 | 55 | 10 | 350000 | 30 | 60 | 90 | 0 | 0.02 | 153 | 240 or more | 0.31 |
| 1-30 | 12000 | 55 | 20 | 350000 | 30 | 60 | 80 | 0 | 0.02 | 144 | 240 or more | 0.33 |
| 1-31 | 12000 | 55 | 30 | 350000 | 30 | 60 | 70 | 0 | 0.04 | 140 | 240 or more | 0.34 |
| 1-32 | 12000 | 55 | 40 | 350000 | 30 | 60 | 60 | 0 | 0.07 | 135 | 240 or more | 0.35 |
| 1-33 | 12000 | 55 | 50 | 350000 | 30 | 60 | 50 | 0 | 0.21 | 125 | 230 or more | 0.35 |

EXAMPLE 2- 1

Five epoxy resins, each consisting of Bisphenol A and epichlorohydrin, having weight average molecualr weights of about 1,000, 3,000, 6,000, 10,000 and 15,000, and each having a glass transition temperature (Tg) of 55° C., were prepared.

A styrene - methyl acylate copolymer (hereinafter referred to as the St/MA copolymer) having a weight average molecular weight of 350,000, a gel content of 30%, and a glass transition temperature of 60° C., was obtained by suspension polymerization of styrene monomer and methyl acrylate monomer, with addition thereto of benzoyl peroxide and divinylbenzene.

35 parts by weight of each of the above-mentioned five epoxy resins, 65 parts by weight of the St/MA copolymer, 10 parts by weight of carbon black, 1 part by weight of Nigrosine dye, and 4 parts by weight of a low molecular weight polypropylene (Trademark "Viscol 550P" made by Sanyo Chemical Industries, Ltd.) were fused and kneaded in a two-roller mill for 1 hour and the mixture was then cooled. The cooled mixture was roughly ground, then finely divided by a jet mill and classified by a pneumatic classifier, whereby five toners No. 2-1 through No. 2-5 according to the present invention, the toner particles of each toner having a volume mean diameter of 11 μm, were obtained.

Each of the above toners was subjected to the same evaluation tests as in Example 1-1. The results are shown in Table 2-1.

TABLE 2-1

| | Epoxy Resin | | | Styrene-methyl acrylate copolymer | | | | Contamination of PVC | Adhesion to Stencil | Lower Limit Temp. (°C.) for | Offset | Charging |
|---|---|---|---|---|---|---|---|---|---|---|---|---|
| No. | Mw | Tg | wt. % | Mw | Gel Ratio | Tg | wt. % | Products | Master | Image Fixing | Temp. (°C.) | Uniformity |
| 2-1 | 1000 | 55 | 35 | 350000 | 30 | 60 | 65 | 0 | 1.00 | 122 | 240 or more | 0.69 |
| 2-2 | 3000 | 55 | 35 | 350000 | 30 | 60 | 65 | 0 | 0.08 | 131 | 240 or more | 0.48 |
| 2-3 | 6000 | 55 | 35 | 350000 | 30 | 60 | 65 | 0 | 0.06 | 138 | 240 or more | 0.37 |
| 2-4 | 10000 | 55 | 35 | 350000 | 30 | 60 | 65 | 0 | 0.05 | 144 | 240 or more | 0.30 |
| 2-5 | 15000 | 55 | 35 | 350000 | 30 | 60 | 65 | 0 | 0.04 | 150 | 240 or more | 0.26 |

Note
Mw: Weight average molecular weight,
Tg: Glass transition temperature,
Gel Ratio: Gel content
wt. %: Mixing ratio of epoxy resin in the toner.

EXAMPLE 2-2

Six epoxy resins, each consisting of Bisphenol A and epichlorohydrin, having glass transition temperatures (Tg) of about 45° C., 50° C., 60° C., 65° C. and 70° C., were prepared. These six epoxy resins were prepared so as to have a weight average molecular weight of 6,000.

With the formulation of 35 parts by weight of each of the above-mentioned six epoxy resins, 65 parts by weight of the St/MA copolymer prepared in Example 2-1, 10 parts by weight of carbon black, 1 part by weight of Nigrosine dye, and 4 parts by weight of a low molecular weight polypropylene (Trademark "Viscol 550P" made by Sanyo Chemical Industries, Ltd.) and under the same procedure as in Example 2-1, toners No. 2-6 through No. 2-11 according to the present invention were prepared.

Each of the above toners was subjected to the same evaluation tests as in Example 1-1. The results are shown in Table 2-2.

TABLE 2-2

| | Epoxy Resin | | | Styrene-methyl acrylate copolymer | | | | Contamination of PVC | Adhesion to Stencil | Lower Limit Temp. (°C.) for | Offset | Charging |
|---|---|---|---|---|---|---|---|---|---|---|---|---|
| No. | Mw | Tg | wt. % | Mw | Gel Ratio | Tg | wt. % | Products | Master | Image Fixing | Temp. (°C.) | Uniformity |
| 2-6 | 6000 | 45 | 35 | 350000 | 30 | 60 | 65 | 0 | 1.00 | 123 | 240 or more | 0.76 |
| 2-7 | 6000 | 50 | 35 | 350000 | 30 | 60 | 65 | 0 | 0.08 | 130 | 240 or more | 0.50 |
| 2-8 | 6000 | 55 | 35 | 350000 | 30 | 60 | 65 | 0 | 0.06 | 138 | 240 or more | 0.37 |
| 2-9 | 6000 | 60 | 35 | 350000 | 30 | 60 | 65 | 0 | 0.05 | 142 | 240 or more | 0.32 |
| 2-10 | 6000 | 65 | 35 | 350000 | 30 | 60 | 65 | 0 | 0.04 | 145 | 240 or more | 0.28 |
| 2-11 | 6000 | 70 | 35 | 350000 | 30 | 60 | 65 | 0 | 0.03 | 154 | 240 or more | 0.24 |

EXAMPLE 2-3

An epoxy resin consisting of Bisphenol A and epichlorohydrin, having a weight average molecular weight of 6,000 and a glass transition temperature (Tg) of 55° C., was prepared.

Five St/MA copolymers having weight average molecular weights of about 150,000, 250,000, 350,000, 450,000 and 550,000 were prepared under the same procedure as in Example 2-1 except that the temperature at the time of polymerization and the amounts of benzoyl peroxide and divinylbenzene were changed. These five St/MA copolymers were prepared so as to have a gel content of 30% and a glass transition temperature of 60° C.

With the formulation of 35 parts by the first mentioned epoxy resin, 65 parts by weight of each of the five St/MA copolymers prepared in the above, 10 parts by weight of carbon black, 1 part by weight of Nigrosine dye, and 4 parts by weight of a low molecular weight polypropylene (Trademark "Viscol 550P" made by Sanyo Chemical Industries, Ltd.) and under the same procedure as in Example 1-1, toners No. 2-12 through No. 2-16 according to the present invention were prepared.

Each of the above toners was subjected to the same evaluation tests as in Example 1-1. The results are shown in Table 2-3.

TABLE 2-3

| | Epoxy Resin | | | Styrene-methyl acrylate copolymer | | | | Contamination of PVC | Adhesion to Stencil | Lower Limit Temp. (°C.) for | Offset | Charging |
|---|---|---|---|---|---|---|---|---|---|---|---|---|
| No. | Mw | Tg | wt. % | Mw | Gel Ratio | Tg | wt. % | Products | Master | Image Fixing | Temp. (°C.) | Uniformity |
| 2-12 | 6000 | 55 | 35 | 150000 | 30 | 60 | 65 | 0 | 0.11 | 129 | 240 or more | 0.28 |
| 2-13 | 6000 | 55 | 35 | 250000 | 30 | 60 | 65 | 0 | 0.08 | 134 | 240 or more | 0.32 |
| 2-14 | 6000 | 55 | 35 | 350000 | 30 | 60 | 65 | 0 | 0.06 | 138 | 240 or more | 0.37 |
| 2-15 | 6000 | 55 | 35 | 450000 | 30 | 60 | 65 | 0 | 0.04 | 142 | 240 or more | 0.45 |
| 2-16 | 6000 | 55 | 35 | 550000 | 30 | 60 | 65 | 0 | 0.03 | 147 | 240 or more | 0.58 |

EXAMPLE 2-4

The same epoxy resin as that employed in Example 2-3, having a weight average molecular weight of 12,000 and a glass transition temperature (Tg) of 55° C., was prepared.

Six St/MA copolymers having gel contents of about 10%, 20%, 30%, 40%, 50%, and 60% were prepared under the same procedure as in Example 2-1 except that the temperature at the time of polymerization and the amounts of benzoyl peroxide and divinylbenzene were changed. These six St/MA copolymers were prepared so as to have a weight average molecular weight of about 350,000 and a glass transition temperature (Tg) of 60° C.

With the formulation of 35 parts by the first mentioned epoxy resin, 65 parts by weight of each of the six St/MA copolymers prepared in the above, 10 parts by weight of carbon black, 1 part by weight of Nigrosine dye, and 4 parts by weight of a low molecular weight polypropylene (Trademark "Viscol 550P" made by Sanyo Chemical Industries, Ltd.) and under the same procedure as in Example 1-1, toners No. 2-17 through No. 2-22 according to the present invention were prepared.

Each of the above toners was subjected to the same evaluation tests as in Example 1-1. The results are shown in Table 2-4.

TABLE 2-4

| | Epoxy Resin | | | Styrene-methyl acrylate copolymer | | | | Contamination of PVC | Adhesion to Stencil | Lower Limit Temp. (°C.) for | Offset | Charging |
|---|---|---|---|---|---|---|---|---|---|---|---|---|
| No. | Mw | Tg | wt. % | Mw | Gel Ratio | Tg | wt. % | Products | Master | Image Fixing | Temp. (°C.) | Uniformity |
| 2-17 | 6000 | 55 | 35 | 350000 | 10 | 60 | 65 | 0 | 0.12 | 128 | 240 or more | 0.29 |
| 2-18 | 6000 | 55 | 35 | 350000 | 20 | 60 | 65 | 0 | 0.08 | 134 | 240 or more | 0.33 |

TABLE 2-4-continued

| No. | Epoxy Resin Mw | Tg | wt. % | Styrene-methyl acrylate copolymer Mw | Gel Ratio | Tg | wt. % | Contamination of PVC Products | Adhesion to Stencil Master | Lower Limit Temp. (°C.) for Image Fixing | Offset Temp. (°C.) | Charging Uniformity |
|---|---|---|---|---|---|---|---|---|---|---|---|---|
| 2-19 | 6000 | 55 | 35 | 350000 | 30 | 60 | 65 | 0 | 0.06 | 138 | 240 or more | 0.37 |
| 2-20 | 6000 | 55 | 35 | 350000 | 40 | 60 | 65 | 0 | 0.04 | 141 | 240 or more | 0.42 |
| 2-21 | 6000 | 55 | 35 | 350000 | 50 | 60 | 65 | 0 | 0.02 | 143 | 240 or more | 0.49 |
| 2-22 | 6000 | 55 | 35 | 350000 | 60 | 60 | 65 | 0 | 0.02 | 145 | 240 or more | 0.62 |

EXAMPLE 2-5

The same epoxy resin as that employed in Example 2-3, having a weight average molecular weight of 6,000 and a glass transition temperature (Tg) of 55° C., was prepared in the same manner as in Example 2-3.

Six St/MA copolymers having a weight average molecular weight of 350,000, a gel content of 30%, and glass transition temperatures (Tg) of 50° C., 55° C., 60° C., 65° C., 70° C. and 75° C. were prepared under the same procedure as in Example 2-1 except that the copolymerization ratio of styrene to methyl acrylate was changed.

With the formulation of 35 parts by the first mentioned epoxy resin, 65 parts by weight of each of the six St/MA copolymers prepared in the above, 10 parts by weight of carbon black, 1 part by weight of Nigrosine dye, and 4 parts by weight of a low molecular weight polypropylene (Trademark "Viscol 550P" made by Sanyo Chemical Industries, Ltd.) and under the same procedure as in Example 1-1, toners No. 2-23 through No. 2-28 according to the present invention were prepared.

Each of the above toners was subjected to the same evaluation tests as in Example 1-1. The results are shown in Table 2-5.

TABLE 2-5

| No. | Epoxy Resin Mw | Tg | wt. % | Styrene-methyl acrylate copolymer Mw | Gel Ratio | Tg | wt. % | Contamination of PVC Products | Adhesion to Stencil Master | Lower Limit Temp. (°C.) for Image Fixing | Offset Temp. (°C.) | Charging Uniformity |
|---|---|---|---|---|---|---|---|---|---|---|---|---|
| 2-23 | 6000 | 55 | 35 | 350000 | 30 | 50 | 65 | 0 | 0.13 | 126 | 240 or more | 0.28 |
| 2-24 | 6000 | 55 | 35 | 350000 | 30 | 55 | 65 | 0 | 0.09 | 133 | 240 or more | 0.32 |
| 2-25 | 6000 | 55 | 35 | 350000 | 30 | 60 | 65 | 0 | 0.06 | 138 | 240 or more | 0.37 |
| 2-26 | 6000 | 55 | 35 | 350000 | 30 | 65 | 65 | 0 | 0.04 | 142 | 240 or more | 0.42 |
| 2-27 | 6000 | 55 | 35 | 350000 | 30 | 70 | 65 | 0 | 0.03 | 144 | 240 or more | 0.49 |
| 2-28 | 6000 | 55 | 35 | 350000 | 30 | 75 | 65 | 0 | 0.02 | 146 | 240 or more | 0.62 |

EXAMPLE 2-6

Toners No. 2-29 through No. 2-33 according to the present invention were prepared by use of the same epoxy resin as that employed in Example 2-3, having a weight average molecular weight of 6,000 and a glass transition temperature (Tg) of 55° C., and the St/MA copolymer employed in Example 2-1, having a weight average molecular weight of 350,000, a gel content of 30% and a glass transition temperature (Tg) of 60° C., under the same procedure as in Example 2-1 except that the mixing ratio of the epoxy resin to the St/MA copolymer was changed to 10:90, 20:80, 30:70, 40:60, 50:50.

Each of the above toners was subjected to the same evaluation tests as in Example 1-1. The results are shown in Table 2-6.

TABLE 2-6

| No. | Epoxy Resin Mw | Tg | wt. % | Styrene-methyl acrylate copolymer Mw | Gel Ratio | Tg | wt. % | Contamination of PVC Products | Adhesion to Stencil Master | Lower Limit Temp. (°C.) for Image Fixing | Offset Temp. (°C.) | Charging Uniformity |
|---|---|---|---|---|---|---|---|---|---|---|---|---|
| 2-29 | 6000 | 55 | 10 | 350000 | 30 | 60 | 90 | 0 | 0.02 | 154 | 240 or more | 0.32 |
| 2-30 | 6000 | 55 | 20 | 350000 | 30 | 60 | 80 | 0 | 0.03 | 146 | 240 or more | 0.34 |
| 2-31 | 6000 | 55 | 30 | 350000 | 30 | 60 | 70 | 0 | 0.05 | 140 | 240 or more | 0.36 |
| 2-32 | 6000 | 55 | 40 | 350000 | 30 | 60 | 60 | 0 | 0.08 | 136 | 240 or more | 0.38 |
| 2-33 | 6000 | 55 | 50 | 350000 | 30 | 60 | 50 | 0 | 0.23 | 125 | 230 or more | 0.41 |

COMPARATIVE EXAMPLE 1

A styrene - butyl methacrylate copolymer having a broad molecular weight distribution was obtained by successively mixing a polymerization initiator, a chain transfer agent, and mixtures of styrene monomer and butyl methacrylate monomer (nBMA) with different mixing ratios. The (Mw/Mn) ratio of the weight average molecular weight (Mw) to the number average molecular weight (Mn) of the thus obtained styrene - butyl methacrylate copolymer (hereinafter referred to as the St/nBA copolymer) was 4.6, and the number average molecular weight was 1700, and the glass transition temperature (Tg) thereof was 75° C.

100 parts by weight of the St/nBA copolymer as a binder resin, 10 parts by weight of carbon black, 1 part by weight of Nigrosine dye, and 4 parts by weight of a low molecular weight polypropylene (Trademark "Viscol 550P" made by Sanyo Chemical Industries, Ltd.) were fused and kneaded in a two-roller mill for 1 hour and the mixture was then cooled. The cooled mixture was roughly ground, then finely divided by a jet mill and classified by a pneumatic classifier, whereby a comparative toner No. 1, having a particle size of 1 um, was obtained.

This toner was subjected to the same evaluation tests as in Example 1-1. The results are shown in Table 7.

COMPARATIVE EXAMPLE 2

A St/nBA copolymer having a ratio (Mw/Mn) of 4.6, a number average molecular weight (Mn) of 1700, and a glass transition temperature (Tg) of 64° C. was prepared in the same manner as in Comparative Example 1.

Comparative Example 1 was repeated except that the St/nBA employed in Comparative Example 1 was replaced by the above prepared St/nBA copolymer, whereby a comparative toner No. 2 was prepared.

This toner was subjected to the same evaluation tests as in Example 1-1. The results are shown in Table 7.

COMPARATIVE EXAMPLE 3

A St/nBA copolymer having a (Mw/Mn) ratio of 15.3, a number average molecular weight (Mn) of 21,000, a glass transition temperature (Tg) of 74° C. and a gel content of 10% was prepared in the same manner as in Comparative Example 1 except that divinylbenzene was added to the reaction mixture at the time of polymerization.

Comparative Example 1 was repeated except that the St/nBA employed in Comparative Example 1 was replaced by the above prepared St/nBA copolymer, whereby a comparative toner No. 3 was prepared.

This toner was subjected to the same evaluation tests as in Example 1-1. The results are shown in Table 7.

COMPARATIVE EXAMPLE 4

Comparative Example 1 was repeated except that 100 parts by weight of the St/nBA employed in Comparative Example 1 was replaced by 100 parts by weight of a polyester resin prepared from polypropylene(2,2)-2,2-(4-hydroxyphenyl) propane, terephthalic acid and pentaerythritol, having a glass transition temperature of 65° C., with an unsoluble portion thereof in chloroform being 17 wt. %, whereby a comparative toner No. 4 was prepared.

This toner was subjected to the same evaluation tests as in Example 1-1. The results are shown in Table 7.

COMPARATIVE EXAMPLE 5

Comparative Example 1 was repeated except that 100 parts by weight of the St/nBA employed in Comparative Example 1 was replaced by 63 parts by weight of a polyester resin prepared from Bisphenol A and maleic anhydride, having a glass transition temperature of 50° C. and a weight average molecular weight of 6000, and 27 parts by weight of styrene - butadiene copolymer having a weight average molecular weight of 1,500,000 and a glass transition temperature (Tg) of 60° C., whereby a comparative toner No. 5 was prepared.

This toner was subjected to the same evaluation tests as in Example 1-1. The results are shown in Table 7.

COMPARATIVE EXAMPLE 6

Comparative Example 1 was repeated except that 100 parts by weight of the St/nBA employed in Comparative Example 1 was replaced by 63 parts by weight of a cross-linked polyester resin prepared by condensation polymerization of terephthalic acid, trimellitic acid, and polypropylene(2,2)-2,2-(4-hydroxyphenyl)propane in the respective molar ratio of 2 : 3 : 6, having a glass transition temperature of 55° C., and 65 parts by weight of styrene - butadiene copolymer having such a molecular weight as indicating peak values in 13,000 and 220,000 by gel permeationg chromatography (GPC), and a glass transition temperature (Tg) of 60° C., whereby a comparative toner No. 6 was prepared.

This toner was subjected to the same evaluation tests as in Example 1-1. The results are shown in Table 7.

TABLE 7

| Comp. No. | Binder Resin | Contamination of PVC Products | Adhesion to Stencil Master | Lower Limit Temp. (°C.) for Image Fixing | Offset Temp. (°C.) | Charging Uniformity |
|---|---|---|---|---|---|---|
| 1 | St/nBMA Mw/Mn = 4.6, Tg 74° C. | 1.13 | 0.29 | 151 | 230 | 0.26 |
| 2 | St/nBMA Mw/Mn = 4.6, Tg 64° C. | 1.41 | 0.47 | 145 | 210 | 0.25 |
| 3 | St/nBMA Mw/Mn = 13.3, Tg 74° C., Gel ratio 10% | 0.95 | 0.08 | 158 | 240 or more | 0.28 |
| 4 | Cross-linked Polyester resin | 0 | 0.36 | 140 | 240 or more | 0.28 |
| 5 | Polyester resin 63 parts/Styrene-butadiene 27 parts (Mw. 1500000) | 0.16 | 0.51 | 135 | 190 | 0.87 |
| 6 | Cross-linked Polyester resin/St/nBA | 0.88 | 0.09 | 148 | 240 or more | 0.29 |

St: Styrene monomer
nBMA: Methacrylic acid-n-butyl ester monomer
nBA: Acrylic acid-n-butyl ester monomer
Mw: Weight average molecular weight
Mn: Number average molecular weight According to the present invention, an excellent toner for developing latent electrostatic images can be provided, which is particularly excellent in offset preventing performance, and low temperature image fixing performance, and which is neither fused to adhere to a master paper for stencil printing during stencil plate making process nor contaminates polyvinyl chloride products. Further, the toner according to the present invention is excellent in charging uniformity and stable in image formation performance even if the ambient conditions vary.

What is claimed is:

1. A toner for developing latent electrostatic images comprising a colorant, and a binder agent which comprises (i) polyester resin having a weight average molecular weight of 8,000 to 16,000, and a glass transition temperature (Tg) of 50° C. to 65° C., or epoxy resin having a weight average molecular weight of 2,000 to 12,000, and a glass transition temperature (Tg) of 50° C. to 65° C., and (ii) styrene - methyl acrylate copolymer having a weight average molecular weight of 200,000 to 500,000, a gel content of 15 to 50%, and a glass transition temperature (Tg) of 55° C. to 70° C.

2. The toner as claimed in claim 1, wherein the component (i) of said binder agent consists of said polyester resin and the content of said polyester resin in said biinder agent is in the range of 20 wt. % to 45 wt. %.

3. The toner as claimed in claim 1, wherein the component (i) of said binder resin consists of said epoxy resin and the content of said epoxy resin in said binder agent is in the range of 20. wt. % to 45 wt. %.

4. The toner as claimed in claim 1, further comprising a thermoplastic resin different from (i) and (ii) and present in an amount of 20 wt. % or less in said binder agent.

5. The toner as claimed in claim 1, further comprising a magnetic material.

* * * * *

UNITED STATES PATENT AND TRADEMARK OFFICE

CERTIFICATE OF CORRECTION

PATENT NO. : 4 908 290

DATED : March 13, 1990

INVENTOR(S) : Yoichiro WATANABE et al

It is certified that error appears in the above-identified patent and that said Letters Patent is hereby corrected as shown below:

On the title page, at item [75], change the name of the last inventor listed therein to ---Harumi Kakigawa---.

On the title page, at item [75], line 2, change "Namazu" to ---Numazu---.

Signed and Sealed this

Fourth Day of June, 1991

*Attest:*

*Attesting Officer*

HARRY F. MANBECK, JR.

*Commissioner of Patents and Trademarks*